US005509260A

United States Patent [19]

Derdeyn

[11] Patent Number: 5,509,260

[45] Date of Patent: Apr. 23, 1996

[54] GUIDING BOW

[75] Inventor: Marc Derdeyn, Zwevegem, Belgium

[73] Assignee: N.V. Bekaert S.A., Zwevegem, Belgium

[21] Appl. No.: 229,130

[22] Filed: Apr. 15, 1994

Related U.S. Application Data

[63] Continuation of Ser. No. 902,360, Jun. 22, 1992, abandoned.

[30] Foreign Application Priority Data

Jul. 23, 1991 [EP] European Pat. Off. ..... 91201929

[51] Int. Cl.[6] ..... D01H 7/80; D01H 1/10

[52] U.S. Cl. ..... 57/58.83; 57/58.54; 57/58.63; 57/115; 57/352

[58] Field of Search ..... 57/58.52, 58.54, 57/58.63, 58.83, 352, 355, 115

[56] References Cited

U.S. PATENT DOCUMENTS

| | | | |
|---|---|---|---|
| 1,684,533 | 9/1928 | Bouvier . | |
| 3,793,819 | 2/1974 | Madalozzo et al. | 57/58.52 |
| 3,945,182 | 3/1976 | Dover et al. | 57/115 X |
| 4,485,614 | 12/1984 | Lindgren | 57/115 X |

FOREIGN PATENT DOCUMENTS

| | | | |
|---|---|---|---|
| 0056362 | 7/1982 | European Pat. Off. . | |
| 618486 | 7/1980 | Switzerland | 57/58.52 |

*Primary Examiner*—William Stryjewski
*Attorney, Agent, or Firm*—Foley & Lardner

[57] ABSTRACT

A guiding bow (1) for an elongated element (3) in a twisting or winding apparatus. At least part of the length of the guiding bow (1) has a transversal cross-section which is streamlined. The core (5) of the guiding bow may be made of a load carrying material, the sheath (7) of a synthetic material.

1 Claim, 2 Drawing Sheets

GUIDING BOW

This application is a continuation of application Ser. No. 07/902,360, filed Jun. 22, 1992, (now abandoned).

BACKGROUND

The present invention relates to a guiding bow or a flyer for an elongated element in a twisting or winding apparatus and to a twisting or winding apparatus comprising such a guiding bow or flyer.

Only the term "guiding bow" is used in what follows. This term also refers to the so-called flyer. A guiding bow is used to guide an elongated element in a twisting apparatus or in a winding apparatus.

The term "twisting apparatus" both refers to an apparatus used for twisting and to an apparatus used for untwisting. A double-twister or buncher is comprised in the term "twisting apparatus". The term "winding apparatus" both refers to an apparatus used for winding and to an apparatus used for unwinding.

The term "elongated element" refers to wires, filaments, yarns, cords, cables or strands. In relation to the present invention, the term "elongated element" more particularly refers to metallic elongated elements such as iron wires, steel cords or copper cables.

The desire for high production output makes that the guiding bows often rotate at high rotational speeds in the above-mentioned apparatus. As a consequence, high centrifugal forces are exerted upon the guiding bows and make construction of the guiding bows and their fixation to the rest of the apparatus critical. Another disadvantageous consequence of the centrifugal forces is that axial forces may be exerted upon the bearings of the apparatus. This reduces the life span of the bearings and increases considerably the maintenance and replacement costs of the apparatus and bearings.

Still another drawback due to the presence of guiding bows is that a lot of noise is produced during the rotation of the guiding bows.

Reduction of the weight of the guiding bows by making them out of a material which is substantially lighter in weight than steel, such as e.g. carbon fiber or a composite material, has led to guiding bows which lack the necessary rigidity and stiffness.

SUMMARY OF THE INVENTION

It is an object of the present invention to avoid the drawbacks of the prior art.

It is another object of the present invention to reduce the weight of the guiding bows.

It is yet another object of the present invention to decrease the centrifugal forces exerted upon the guiding bows.

It is a further object of the present invention to decrease the energy losses during rotation caused by the presence of the guiding bow.

It is still another object of the present invention to decrease the level of noise produced during rotation of the guiding bow.

According to a first aspect of the present invention, there is provided a guiding bow for an elongated element in a twisting or winding apparatus. The guiding bow comprises a core and a sheath. The core is made of a load carrying material and the sheath is made of a synthetic material which does not necessarily carry load. In this way the functions of the flyer have been divided. The core resists the external forces and gives the required rigidity. As a representative example, the core may be made of carbon fiber. The sheath may be made of a synthetic material and may be used to give a streamlined shape to the transverse cross-section of entire guiding bow or to protect the more expensive core material against damage caused by possible fractures of the elongated element.

The term "streamlined" refers to a minimum dimensionless drift coefficient which is smaller than 0.40, preferably smaller than 0.30. The dimensionless drift coefficient will be defined herein below. The minimum dimensionless drift coefficient is the drift coefficient of the guiding bow when this guiding bow is so arranged with respect to the direction of movement that it has a minimum stream resistance.

The guiding bow may be—at least partially—made of a material with a specific gravity lower than 4 kg/dm$^3$. Examples of such a material are aluminium, carbon fiber or fibre reinforced composite materials.

Preferably, openings are provided in the sheath at the bottom side of the guiding bow. This facilitates the wiring of the apparatus.

According to a second aspect of the present invention, there is provided a winding or twisting apparatus which comprises at least one guiding bow as described hereabove. The twisting apparatus may be a double-twister or buncher.

Preferably, the guiding bow is arranged with respect to its direction of movement and has a cross-sectional profile such that the dimensionless drift coefficient $C_D$ is lower than 0.20, e.g. lower than 0.15 or lower than 0.10. The lower the drift coefficient the lower the stream losses are during rotation of the guiding bow.

Preferably, the guiding bow is arranged with respect to its direction of movement and has such a cross-sectional profile that the dimensionless lift coefficient $C_L$ is negative. A negative lift coefficient gives rise to a lift force $F_L$ which is directed in the other sense than the centrifugal force. As a consequence, the lift force may compensate at least partially for the centrifugal force.

The terms drift coefficient and lift coefficient are well known in the art but in order to avoid all doubts their formula are given here below:

$$F_D=C_D\times A\times\tfrac{1}{2}pv^2$$

$$F_L=C_L\times A\times\tfrac{1}{2}pv^2$$

whereby $F_D$ is the drift force;

$F_L$ is the lift force;

$C_D$ is the dimensionless drift coefficient;

$C_L$ is the dimensionless lift coefficient;

A is the surface of the profile to be concerned;

p is the specific gravity of the fluid;

v is the relative velocity of the profile with respect to the fluid.

BRIEF DESCRIPTION OF THE DRAWINGS

The invention will now be further explained with reference to the accompanying drawings wherein.

DESCRIPTION OF THE PREFERRED EMBODIMENT

Figure 1:
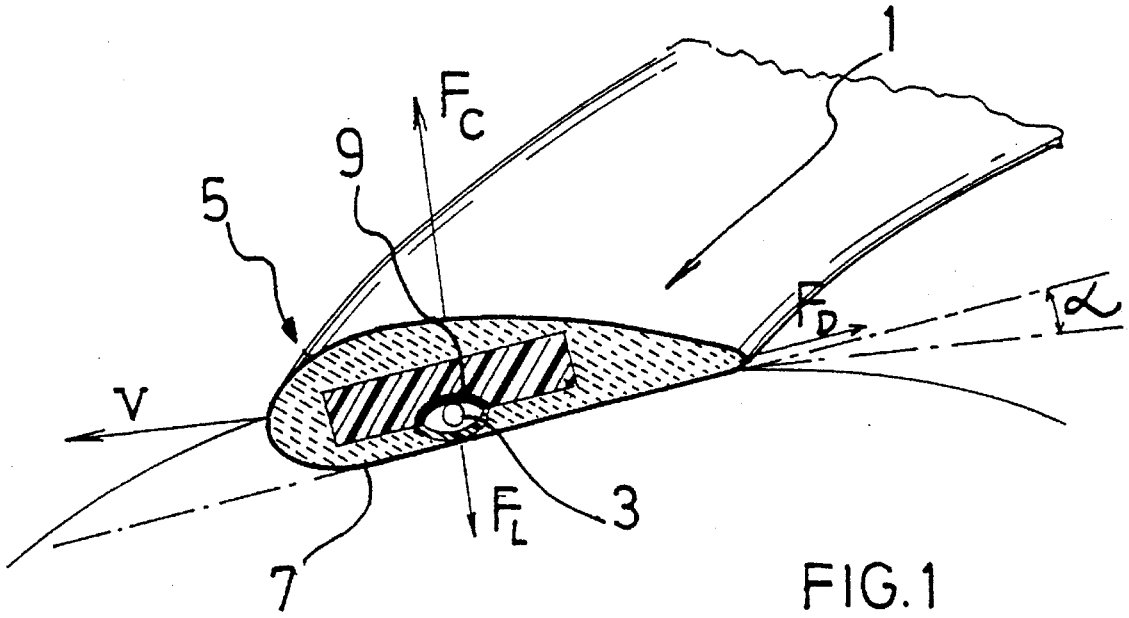
FIG. 1 is a transverse cross-section of a guiding bow according to the present invention.

The guiding bow 1 illustrated in FIG. 1 guides a steel cord 3. The guiding bow 1 comprises a core 5 and a sheath 7. The core 5 is made of carbon fiber and the sheath 7 is made of a synthetic material which has been extruded around the core 5 and which defines in a transverse cross-section of the guiding bow, a streamlined profile to the guiding bow 1. That part of the carbon fiber core 5 which is in contact with the steel cord has been coated with a layer 9 of a suitable hardmetal.

The guiding bow is rotating in the direction v and a centrifugal force $F_C$ is exerted upon the guiding bow 1. The other forces which are exerted upon the guiding bow 1 are the drift force $F_D$ and the lift force $F_L$. It is generally known in the art of aerodynamics that the magnitude of these two forces $F_D$ and $F_L$ are dependent upon the cross-sectional profile of the guiding bow 1 and upon the direction of the profile with respect to the direction of movement v. This direction may be characterized by the angle $\alpha$. The cross-sectional profile of the bow and the angle $\alpha$ should be chosen so as to minimize the drift force $F_D$. The cross-sectional profile of the bow and the angle $\alpha$ should also be chosen such that the lift force $F_L$ has a sense of direction different from the sense of direction of centrifugal force $F_C$ since, in contradistinction with airplanes, a lift of the bow is not desired here. In case this is not possible, the cross-sectional profile of the bow and the angle $\alpha$ should be so chosen that the lift force $F_L$ is as small as possible.

Figure 2:
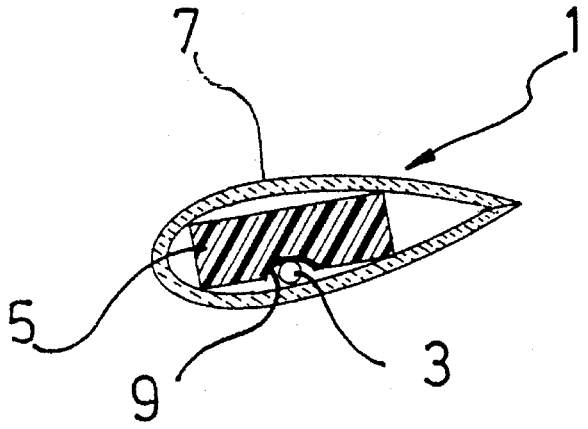
FIG. 2 is a transverse cross-section of another guiding bow according to the present invention.

FIG. 2 illustrates another embodiment of the present invention. The core 5 is surrounded by a sheath 7 which gives the streamlined profile to the guiding bow 1. The sheath 7 is such that it may be quickly replaced.

Figure 3:
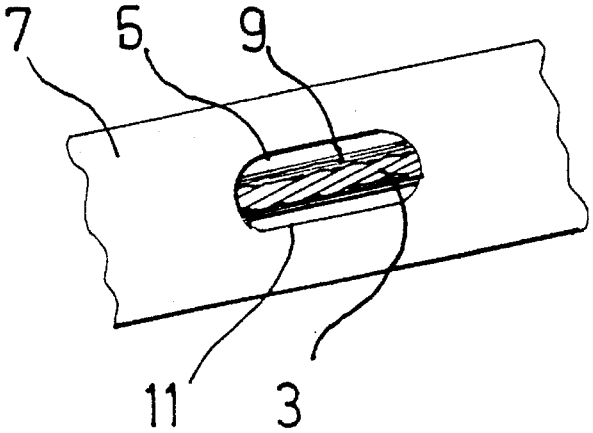
FIG. 3 is a bottom view of a guiding bow according to the present invention.

FIG. 3 shows a bottom view of a guiding bow according to the present invention. The bottom side of the sheath 7 of the guiding bow 1 is provided with openings 11 which facilitate the wiring of the bow 1.

Figure 4:
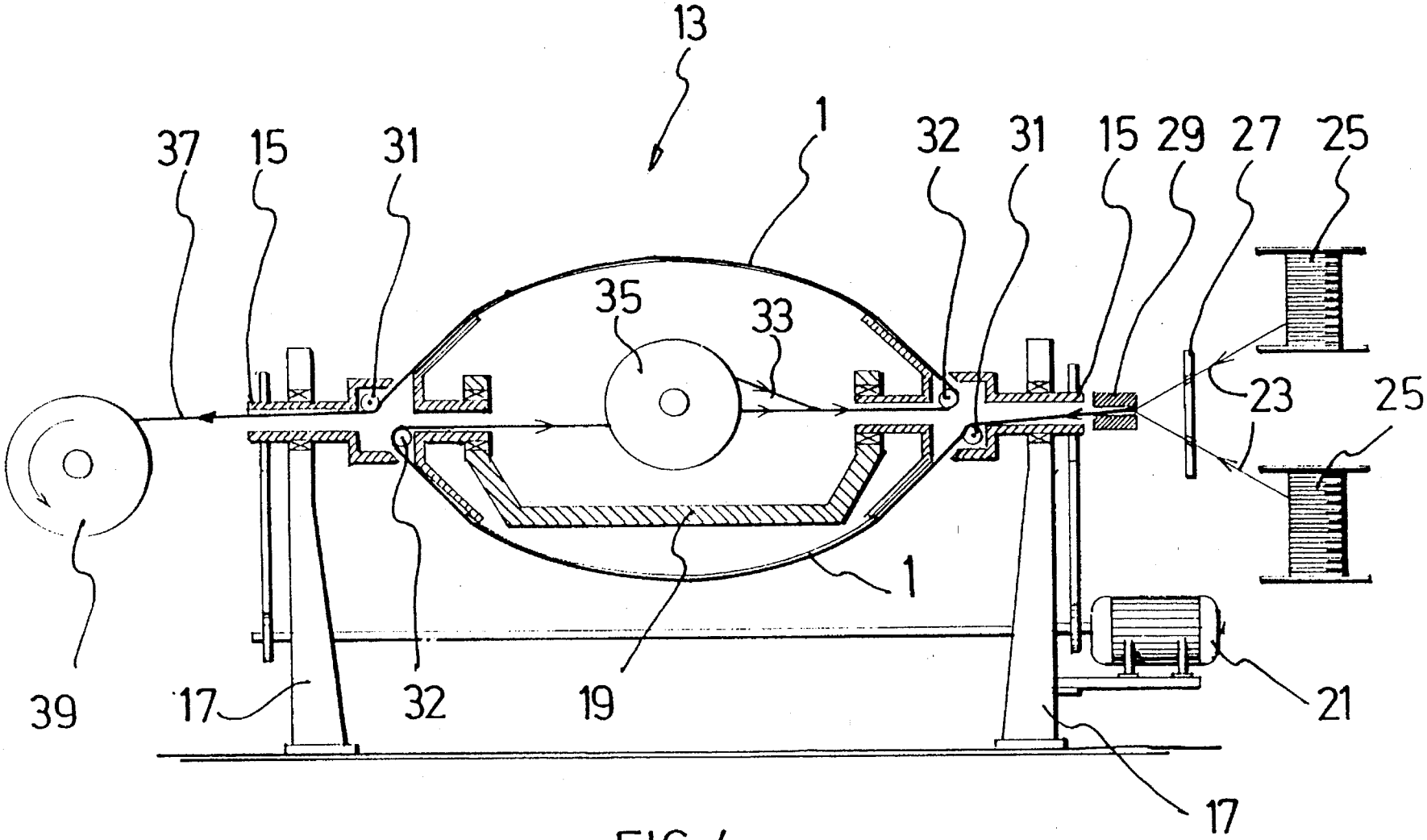
FIG. 4 is a schematic assembly view of a double-twister.

By way of example, FIG. 4 shows an assembly view of a double-twister 13 comprising two guiding bows 1 according to the present invention. The wiring of the double-twister 13 is such that a 2+1-steel cord construction will be manufactured.

The double-twister 13 comprises two half-shafts 15 which are supported by means of bearings in a housing 17. The two half-shafts 15 are connected by the two guiding bows 1. A cradle 19 is stationarily mounted on the two half-shafts 15. The two half-shafts 15 are driven by means of an electric motor 21. The functioning of the double-twister is as follows :Two steel filaments 23 which are drawn from two supply bobbins 25, are guided through a distribution disc 27 and come together at an assembly point 29. They are further guided through the first half-shaft 15 and over a first guiding pulley 31 where they receive a first twist. The filaments 23 are then guided via the guiding bow 1 to a first reversing pulley 32 where the filaments 23 receive a second twist. Inside the rotor of the double-twister a third filament 33 is drawn from a bobbin 35 and brought together with the filaments 23. The three filaments 22, 23 are guided towards a second reversing pulley 32 where the filaments 23 are partially untwisted and where the filament 33 is twisted a first time around the filaments 23. The filaments 23,33 are guided via the second guiding bow 1 towards a second guiding pulley 31 where the filaments 23 are untwisted completely and where the filament 33 is twisted a second time around the filaments 23. The finished cord 37 then passes through the half-shaft 15 and is wound upon the bobbin 39. Conventional rotational speeds of the guiding bows 1 lie between 3000 and 6000 rpm.

I claim:

1. An apparatus for winding or twisting an elongated element, the apparatus comprising:

at least one bobbin filled with said elongated element; and at least one guiding bow which receives said elongated element from said at least one bobbin, said guiding bow guiding said elongated element around said apparatus during winding or twisting;

wherein said guiding bow includes a core and a sheath completely surrounding the core, said core being made of a load carrying material which resists substantially all forces exerted upon the guiding bow, and said sheath being made of a synthetic material and formed to give said guiding bow a predetermined cross-sectional shape; and wherein the guiding bow is oriented with respect to a direction of movement of the guiding bow such that during movement of the guiding bow the predetermined cross-sectional shape of the guiding bow ensures that a dimensionless lift coefficient $C_L$ is negative.

* * * * *